US005498054A

United States Patent [19]

Tomlinson

[11] Patent Number: 5,498,054

[45] Date of Patent: Mar. 12, 1996

[54] ADJUSTABLE KNOCK DOWN CHAIR

[76] Inventor: Richard S. Tomlinson, 1189 Hillsboro Mile #2, Hillsboro Beach, Fla. 33062

[21] Appl. No.: 393,202

[22] Filed: Feb. 23, 1995

[51] Int. Cl.[6] ..... A47C 4/00

[52] U.S. Cl. ..... 297/16.2; 297/378.1; 297/361.1; 297/440.24; 297/53

[58] Field of Search ..... 297/16.2, 16.1, 297/27, 35, 39, 40, 440.1, 440.24, 449, 452.2, 452.18, 378.1, 359, 360, 354.12, 361.1, 53; 403/349, 318, 319

[56] References Cited

U.S. PATENT DOCUMENTS

| | | | |
|---|---|---|---|
| 2,209,145 | 7/1940 | Weber | 297/440.24 X |
| 2,871,921 | 2/1959 | Arnold | 297/39 |
| 3,778,102 | 12/1973 | Snyder et al. | 403/349 X |
| 3,907,362 | 9/1975 | Zerlaut | 297/440 |
| 4,541,666 | 9/1985 | Vanderminden | 297/16 |
| 4,773,708 | 9/1988 | Nastu | 297/229 X |
| 4,784,436 | 11/1988 | Sutherland | 297/440 |
| 4,863,181 | 9/1989 | Howle | 403/349 X |
| 4,867,505 | 9/1989 | Parker | 297/27 |
| 4,889,383 | 12/1989 | Jones | 297/16 |
| 4,890,882 | 1/1990 | Harrington | 297/45 |
| 4,917,525 | 4/1990 | Duncan | 403/349 X |
| 5,058,949 | 10/1991 | Von Hoffman | 297/440.24 X |
| 5,244,250 | 9/1993 | Nordmeyer | 297/59 |
| 5,318,346 | 6/1994 | Roossien et al. | 403/349 X |

*Primary Examiner*—Milton Nelson, Jr.
*Attorney, Agent, or Firm*—Alvin S. Blum

[57] ABSTRACT

An improved reclining, knock down chair assembly having a plurality of tubular members which define a seat frame, a back frame connected pivotally to the rear end portion of the seat frame at the lower portion, two leg frames which are engagable in a locking position, and two spaced arm support, frames provided on two sides of the backrest frame. A particular feature of the device is that the chair is pivotal to any position from an upright position to a fully reclined position because of the employment of the telescopic positioning device of the arm frame. Another particular feature is that the three laterally disposed tubular support members are attached to the different frames by quick release couplings which allows the entire assembly to be broken down into a compact state which is then secured in a tote bag.

6 Claims, 5 Drawing Sheets

24
40
42
43
44
46
48
50
52
53
55
56
58
60
63
64
65
66
67
68
69
70
71
72
73

ADJUSTABLE KNOCK DOWN CHAIR

BACKGROUND-FIELD OF INVENTION

This invention relates to an improved adjustable reclining chair of the recreational type and which is adapted to breakdown for easy transport and storage purposes.

BACKGROUND-DESCRIPTION OF PRIOR ART

There are many types of knock down or folding chairs available to the public for beach use. These chairs are also used for other recreational activities such as picnics, camping, concerts, or sporting events. It is desirable that these assemblies be presented in a lightweight and compact form so they can be easily carried by a person when walking, when riding a bicycle, when riding a skateboard, or when using roller blades to travel to these activities. Known types of knock down or folding chairs provide a convenience of a chair together with compactness of storage and ease of transport.

In known types of folding chairs, these chairs occupy less space than a non folding chair. A difficulty arises for these chairs tend to fold to a bulky single plane, hence making them very cumbersome to carry.

In known types of knock down chairs, the assembly folds and collapses transversely into two planes thus making the assembly even more compact. A difficulty arises for these knock down chair assemblies also tend to be cumbersome and very awkward to carry. Another difficulty arises when in transport, the different parts of the chair assembly tend to open such as the leg and back supports. Another undesirable feature of these known types of knock down chairs is the large number of parts that these chairs employ which makes the assembly and disassembly of these chairs very time consuming.

Various constructions have been proposed to form a knock down chair from elongated tubular strength members which are joined by coupling devices such as elbows, snap ons, spring loaded snap clips, or T's to form the frame of the chair. Many difficulties arise when assembled or disassembled. These assemblies all constitute a large number of separate parts that are cumbersome to carry and to store. Also, these coupling devices tend to weaken the integrity of the tubular members, whereby the tubular members would risk being fatigued. Further, such knock down chairs often have a complex structure with a plurality of steps and require more manipulation to assemble or disassemble.

Some of the known prior art provide different limited multi-position arm assemblies for the reclining of the back portion of such chairs. In some cases, these knock down chairs provide only the upright position for an occupant,. In other cases, these chairs have frames that have been articulated to each other to only permit the reclining of the chair from an upright position to a lay flat position.

This problem has been partially solved by the implementation of an arm rest mechanism that is pivotally attached to the back portion and slidably secured to a mount, of the seat, portion. The armrest mechanism has a series of holes or notches in the underside of the armrests for receiving the upper portion of the mount, so as to lock the armrest with respect to the different reclining positions. However, these chair assemblies are cumbersome to use, especially if the armrests are not, simultaneously raised to change the reclining position. In addition, these chair assemblies are all limited to their number of reclining positions.

Nevertheless, all the reclining, knock down or folding chairs heretofore known suffer from a number of disadvantages. The prior art does not satisfy the ever increasing public demand for additional convenience and comfort.

A number of U.S. Patents that are pertinent to but do not, teach or suggest the present invention are: U.S. Pat. Nos. 3,907.362. 4,541,666, 4,784,436, 4,867,505, 4,889,383, 4,890,882, and 5,244250.

OBJECTS AND ADVANTAGES

Accordingly, besides the objects and advantages of the knock down adjustable chair described in the above patent, several objects and advantages of the present invention are, (a) to provide a knock down chair which comprises a frame comprising of a plurality of sections, that is, a seat,, a backrest, an optional footrest (not shown or discussed), two armrest sections, and two leg frame sections, each section being fabricated of tubular strength members;

(b) to provide a knock down chair which will present improved and superior quick release couplings for interconnecting the various tubular strength members one another;

(c) to provide a knock down chair that employs handle grips at each of the perspective ends of the various support members for protection from abrasive surfaces and for ease of assembly and disassembly;

(d) to provide a knock down chair with identical and interchangeable tubular support members for ease of assembly and disassembly;

(e) to provide a knock down chair which is easily and quickly assembled or disassembled without the need of tools or special skills;

(f) to provide a knock down chair which when dismantled is easy to transport and to store;

(g) to provide a knock down chair that when in the knock down state, the entire assembly can be positioned and stored into a tote bag which conveniently holds all components and that such components are readily accessible for immediate assembly;

(h) to provide a knock down chair that incorporates the same fabric material, color, and pattern for chair support and tote bag;

(i) to provide a knock down chair with an improved armrest mechanism with unlimited adjustment positions;

(j) to provide a knock down chair which comprises a minimum of parts and which is thus ultra light; and (k) to provide a knock down chair that is economical to manufacture.

Further objects and advantages are to provide a chair which can be easily compacted, effortlessly assembled or disassembled, which is simple to use, and inexpensive to manufacture.

The novel features which are believed to be characteristic of the invention, both as to organization and method of operation, together with further objects and advantages thereof will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DRAWING FIGURES

Reference Numerals In Drawings

| | |
|---|---|
| 10 knock down chair | 12 backrest frame |
| 14 set frame | 16 arm support frame |
| 18 leg frame | 20 tubular side member (back) |
| 22 top support member | 24 quick release coupling |
| 26 tubular side member (seat) | 28 canvas body support |
| 30 tubular side member (leg) | 32 bottom support member |
| 34 handle grip | 36 male tubular member (arm) |
| 38 female tubular member (arm) | 40 male body |
| | 43 flange |
| 42 female body | 46 wide portion |
| 44 flange | 50 cammed surface |
| 48 narrow portion | 53 pin, rivet, or bolt |
| 52 washer | 56 neck |
| 55 tang | 60 receiver |
| 58 receiver | 64 free wheeling coupling |
| 63 flange | 66 receiver |
| 65 bolt | 68 washer |
| 67 nut | 70 telescopic positioning device |
| 69 washer | 72 flange |
| 71 cylindrical main body | 74 back support hinge |
| 73 cylindrical cam | 78 female component (hinge) |
| 76 leg support hinge | 82 tote bag |
| 80 male component (hinge) | |
| 84 closure | |

DESCRIPTION

Figure 1:
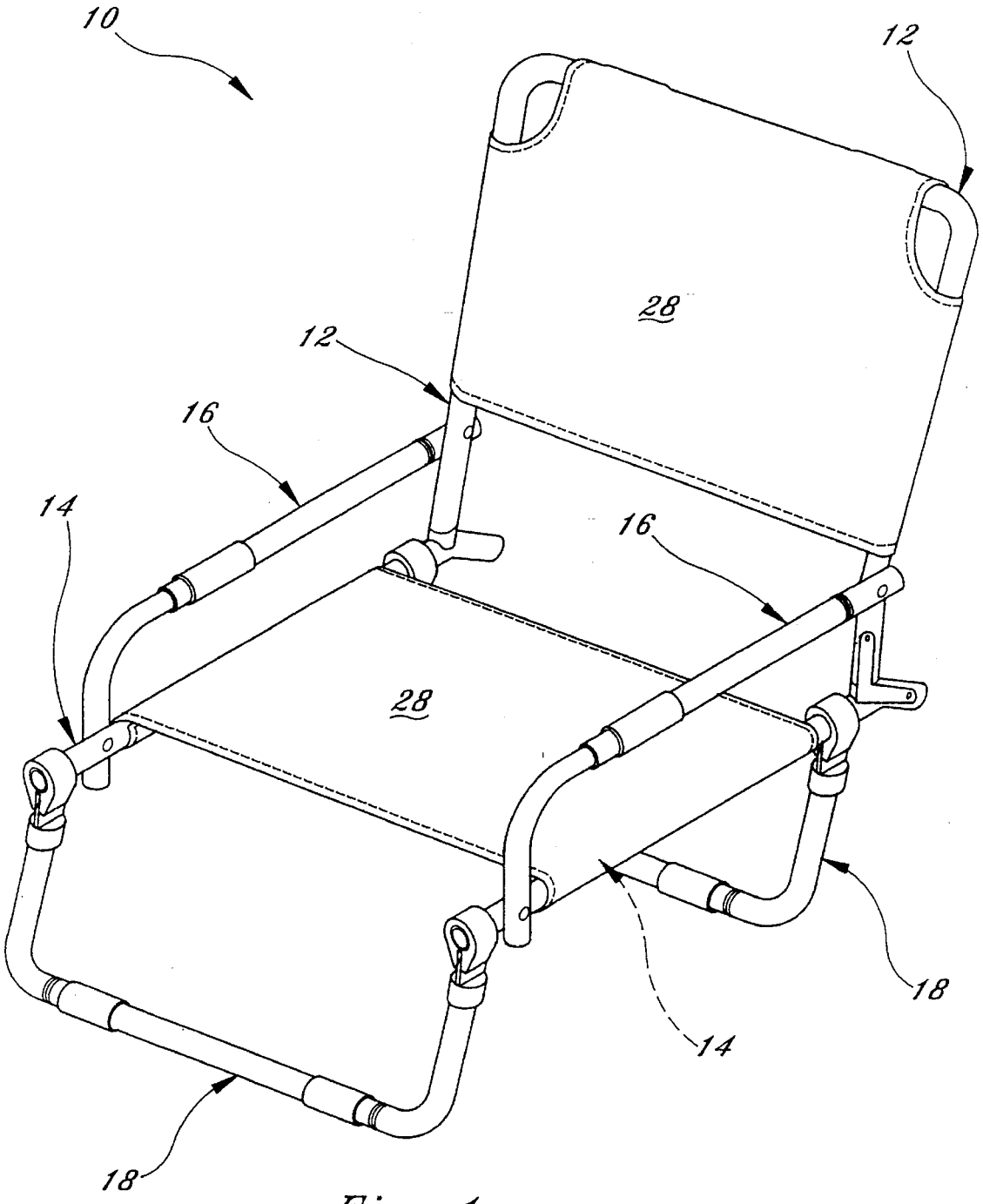
FIG. 1 is a perspective view of a knock down chair made in accordance with the present invention.
Figure 2:
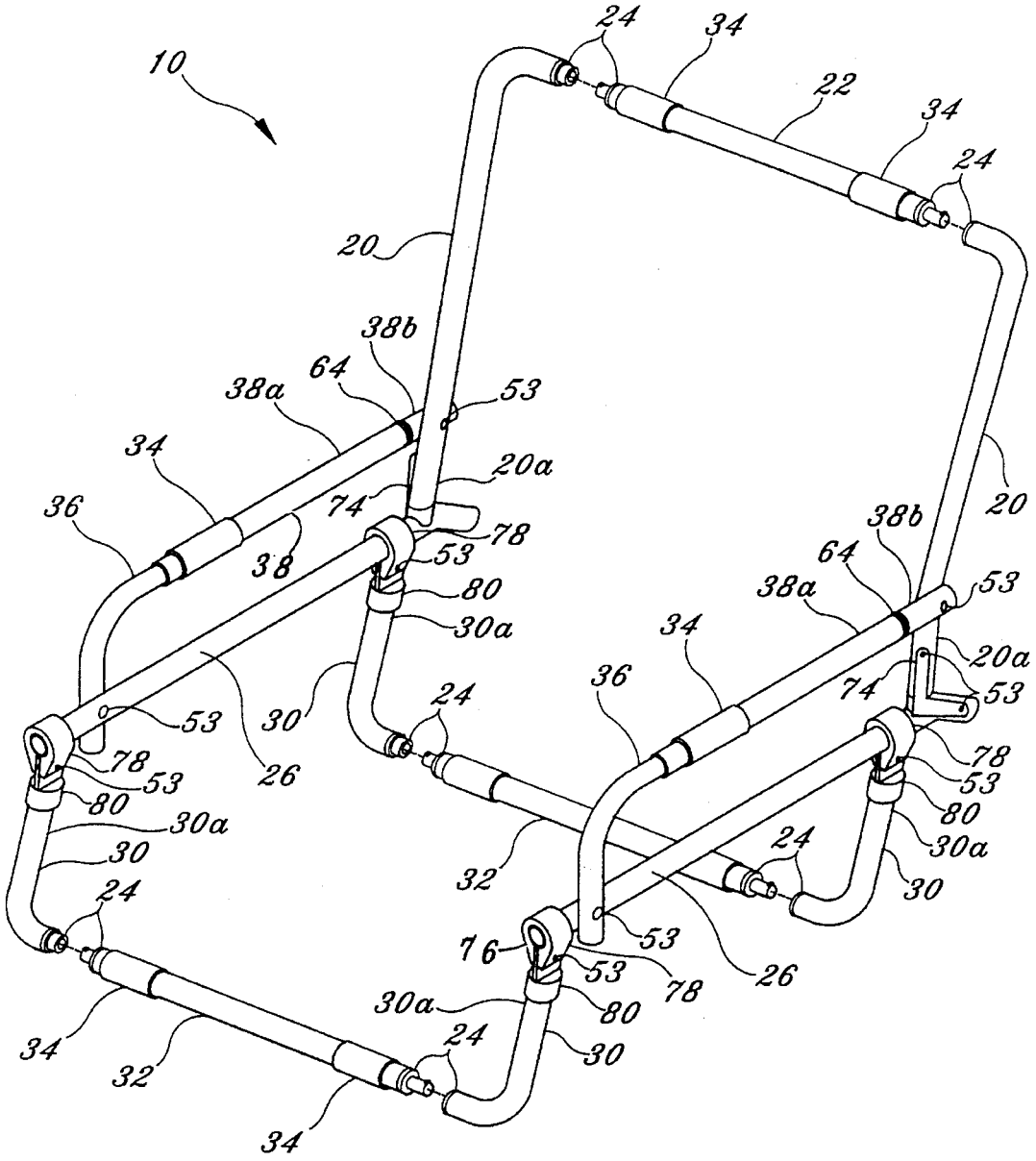
FIG. 2 is an illustration showing a fragmented view of the support members and quick release couplings illustrating the connecting means for the tubular strength members for the assembly of the chair in FIG. 1.

Referring to FIGS. 1 and 2, a knock down chair 10 according to this invention preferably includes a backrest frame 12, a seat frame 14, two spaced arm supporting frames 16, and a front and rear leg frame 18.

The backrest frame 12 preferably is comprised of two parallel tubular members 20 and a top support tubular member 22. The members 20 are connected with the member by a pair of quick release couplings 24. These couplings 24 will be described in further detail below.

The seat frame 14 is preferably comprised of two parallel tubular members 26. A fabric such as canvas or any conventional resilient seating material is extended over the frame 12 and frame 14 creating a body support 28 for the back and seal of a person when chair 10 is in use. The body support 28 is preferably of one piece and preferably made of canvas.

The bottom ends 20*a* of the members 20 of the frame 12 are hingedly connected on each side of the frame 14 on the rear portions of the members 26 thereof by conventional hinge means 74.

Referring to FIG. 2, the front and rear leg frame 18 preferably are each comprised of two parallel tubular members 30 and a bottom support member 32. The members 30 and the member 32 are connected by the identical quick release couplings 24 that will again be described in further detail below.

The leg frames 18 are pivotally attached to the pair of parallel tubular members 26 of the seat frame 14 by a leg support hinge 76 comprising of two components 78, 80 shown in FIG. 2. The female component 78 of the hinge slides over telescopically and positions at the opposite ends of the tubular members 26. The male component 80 of the hinge telescopically fits into the top 30*a* of the leg side members 30 secured by glue or any conventional means.

It will be noted that the tubular support members 22. 32 have handle grips 34 which are attached preferably by glue at the opposite ends of each respective members 22, 32.

Figures 3, 4, 5, 6, 7:
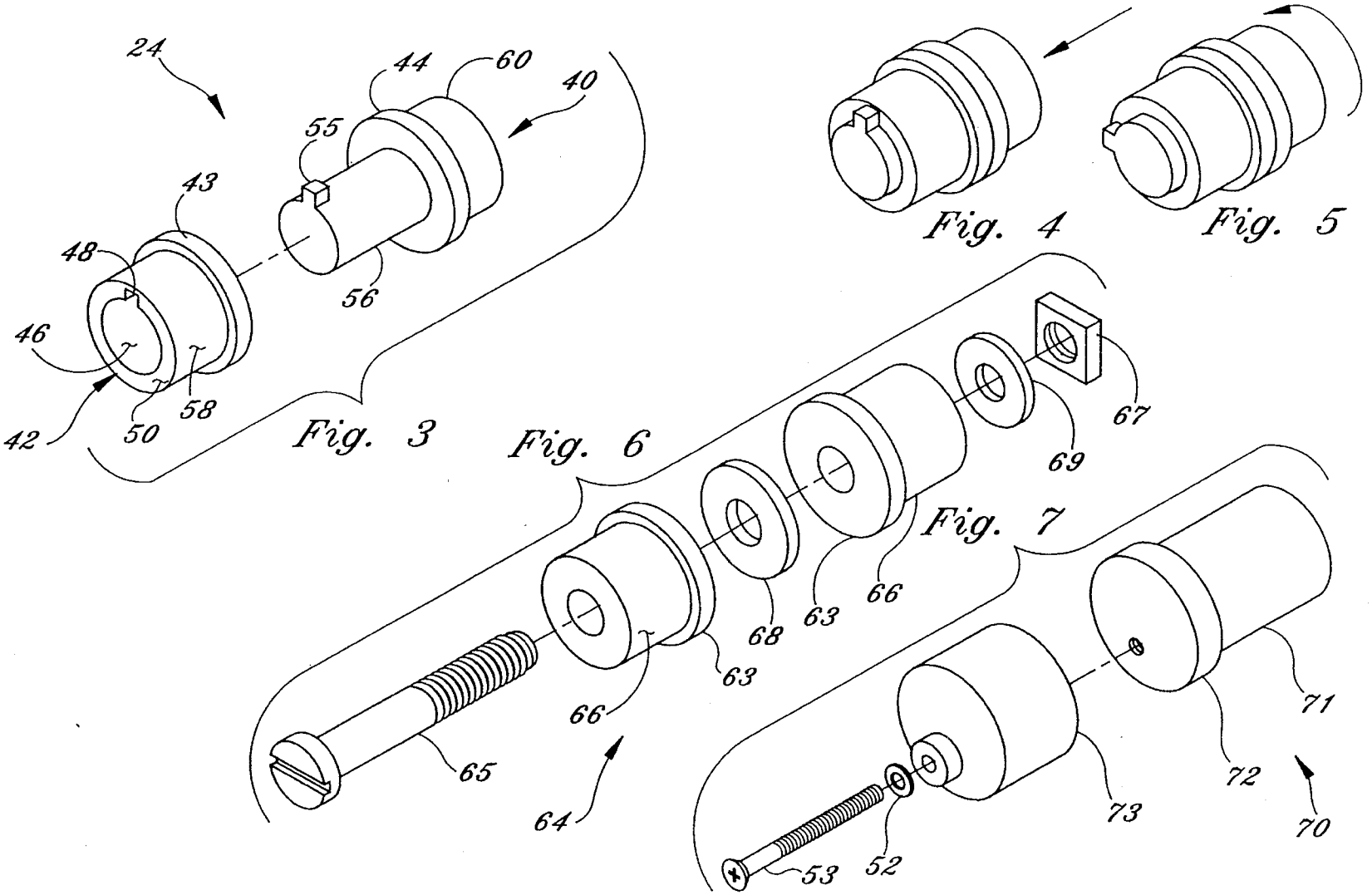
FIG. 3 is an exploded view of the quick release coupling of the chair in FIG. 1.
FIG. 4 is a similar view of the quick release coupling but in its semi joined state.
FIG. 5 is a similar view of the quick release coupling but in its locked state.
FIG. 6 is an exploded view of the free wheeling coupling of the chair according to the present invention.
FIG. 7 is an exploded view illustrating one of the positioning members of the reclining mechanism of the chair according to the present invention.

Referring to FIG. 3, the quick release coupling 24 according to this invention comprises of a male body 40 and a female body 42. The coupling 24 is preferably made of mold injected plastic. The female body 42 comprises of a flange 43, an opening defining a relatively wide portion 46 and a relatively narrow portion 48. The opening of the female body 42 is shaped preferably like a keyhole.

The male body 40 comprises of a tang 55, a flange 44, a neck 56 and a receiver 60. The tang 55 is dimensioned to pass through the narrow portion 48. The neck 56 is dimensioned to pass through the wide portion 46.

As shown in FIG. 4 and 5, when the neck 56 and tang 55 of the male body 40 is inserted to a predetermined depth into the wide portion 46 and narrow portion 48 of the female body 42, its end is projected for a predetermined length from the beveled camed surface 50 of the female body 42. When the neck 56 and tang 55 of the body 40 projects from the beveled earned surface 50 of the body 42 and the body 40 is turned, the neck 56 and the tang 55 is now in frictional contact with the earned surface 50 of the body 42. The coupling 24 is now in its locked state.

The receivers 58, 60 are dimensioned to telescopically fit inside of the opposite receiving ends of the top support 22 and of the opposite receiving ends of the front and rear bottom supports 32. A flange 43, 44 is used at the top of base 58, 59 to position the bodies 40, 42 at the respective ends of the supports 22, 32.

As shown in FIG. 7, it is a particular feature of the chair construction of the present invention that the telescopic positioning device 70 allows the back frame 12 to adjust to any position of rearwardly adjusted angularity relative to the seat frame 14. The device 70 will hold in assembled relationship the male tubular member 36 within the female tubular member 38 in a locking telescopic relationship. The device 70 is preferably made from mold injected plastic.

As shown in FIG. 2, in order to be able to adjust the position of the backrest frame 12 relative to the seat frame 14, two parallel arm support frames 16 are provided on the two opposite sides of the frame 12 shown at each side of the chair 10 including in each instance a female tubular member 38 which is pivotally connected at its rear end to the frame 12 by means of a pin, rivet or bolt 53. A male tubular member 36 is telescopically fitted inside of each tubular member 38 and is pivotally connected at its front end by means of a pin, rivet or bolt 53 to the front end of the corresponding tubular member 26 of the seat frame 14. A telescopic positioning device is fastened preferably by an adhesive to the rear end of the member 36.

In the preferred embodiment the positioning device 70 of the arm support frame 16 includes a cylindrical main body 71, a flange 72, a cylindrical cam 73, and a pin, rivet, or bolt 53. The main body 71 and flange 72 are of the same assembly. The main body 71 slides inside the rear portion of the tubular member 36 and is fastened either by crimping or glue. The flange 72 of the device 70 and the male tubular member 36 have a slightly smaller circumference than the tubular member 38 which allows both to travel freely for two way movement inside the tubular member 38. The cam 73 is positioned slightly off centered on the top of the main body 71 and fastened by means of a pin, rivet or bolt 53. The surfaces of the cam 73 prevent movement between the telescoping tubular members 36 and 38 until such time as the tubular member 38 is manually turned to release the cam 53. This causes the cam 73 to change position providing clearance between itself and the tubing 38 which allows for two way movement or allows for a locking relationship. Hence, by turning the tubular member 38 simultaneously in either direction, the chair 10 has an unlimited number of reclining positions.

As shown in FIG. 2 and FIG. 6, each of the members 38 is comprised of two sections 38*a* and 38*b* which have an intermediate portion which is connected by a free wheeling coupling 64 that allows the tubular member 38 to spin freely. The coupling 64, shown in FIG. 6, comprises preferably of two receivers 66, a bolt 65, a washer 68, a washer 69, and a nut 67. The receivers 66 telescopically fit inside of the receiving ends of the two sections 38*a* and 38*b*. A flange 63 is used at each respective end at sections 38*a* and 38*b* to position the coupling 64.

OPERATION

Thus it will be appreciated that the telescopic positioning device 70 may be readily adjusted to any desired position by simply turning the tubular members 38 of the arm support frame 16. It will also be appreciated that this mode of control provides a marked advance in simplicity of instruction and convenience of operation for the user. It eliminates the necessity for fumbling around in an effort by the other more conventional types of positioning device.

Figure 8:
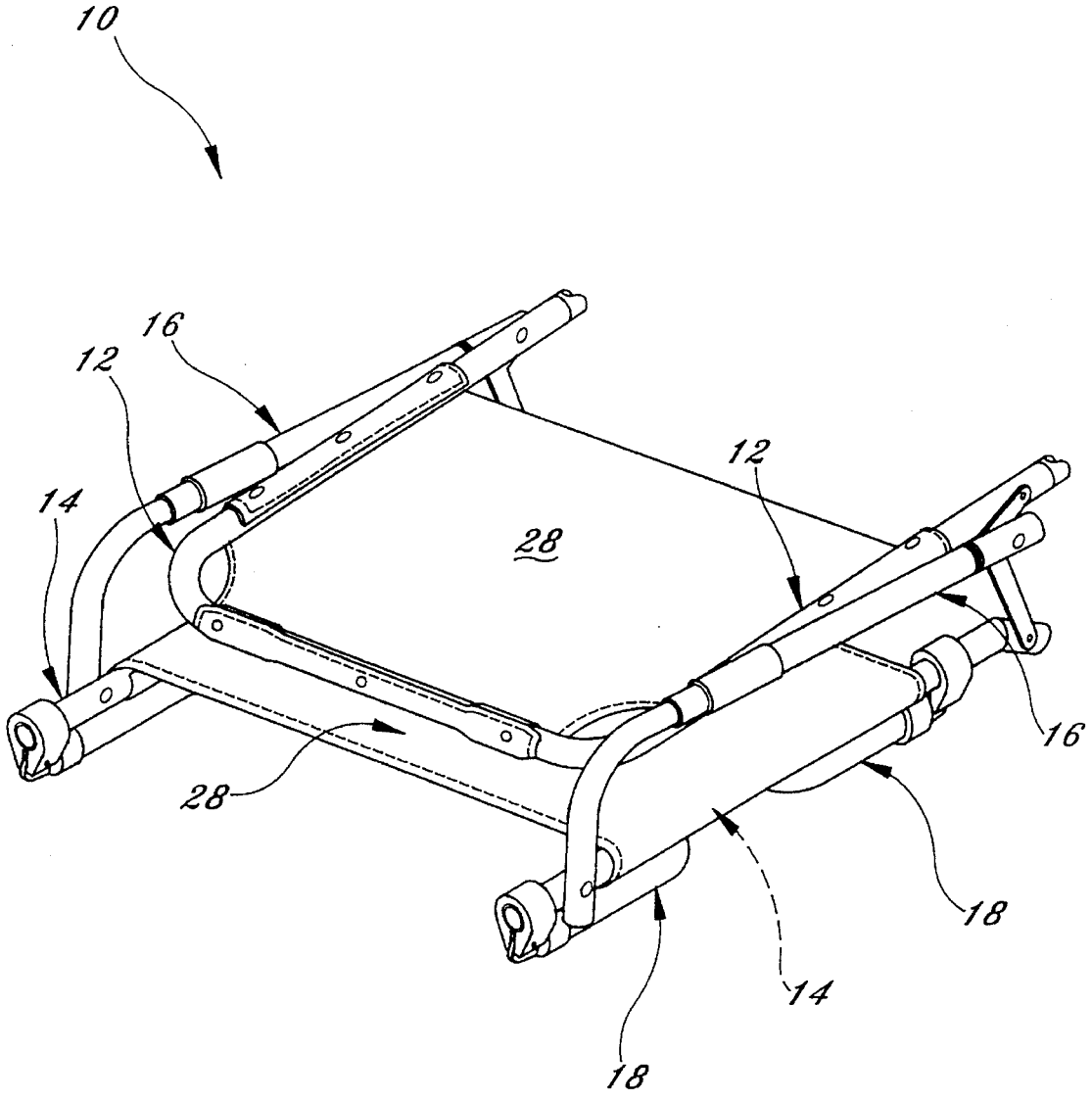
FIG. 8 is a view of the chair in FIG. 1 illustrating the folding movement of the backrest frame and the arm supporting frame relative to the seat frame.
Figure 9:
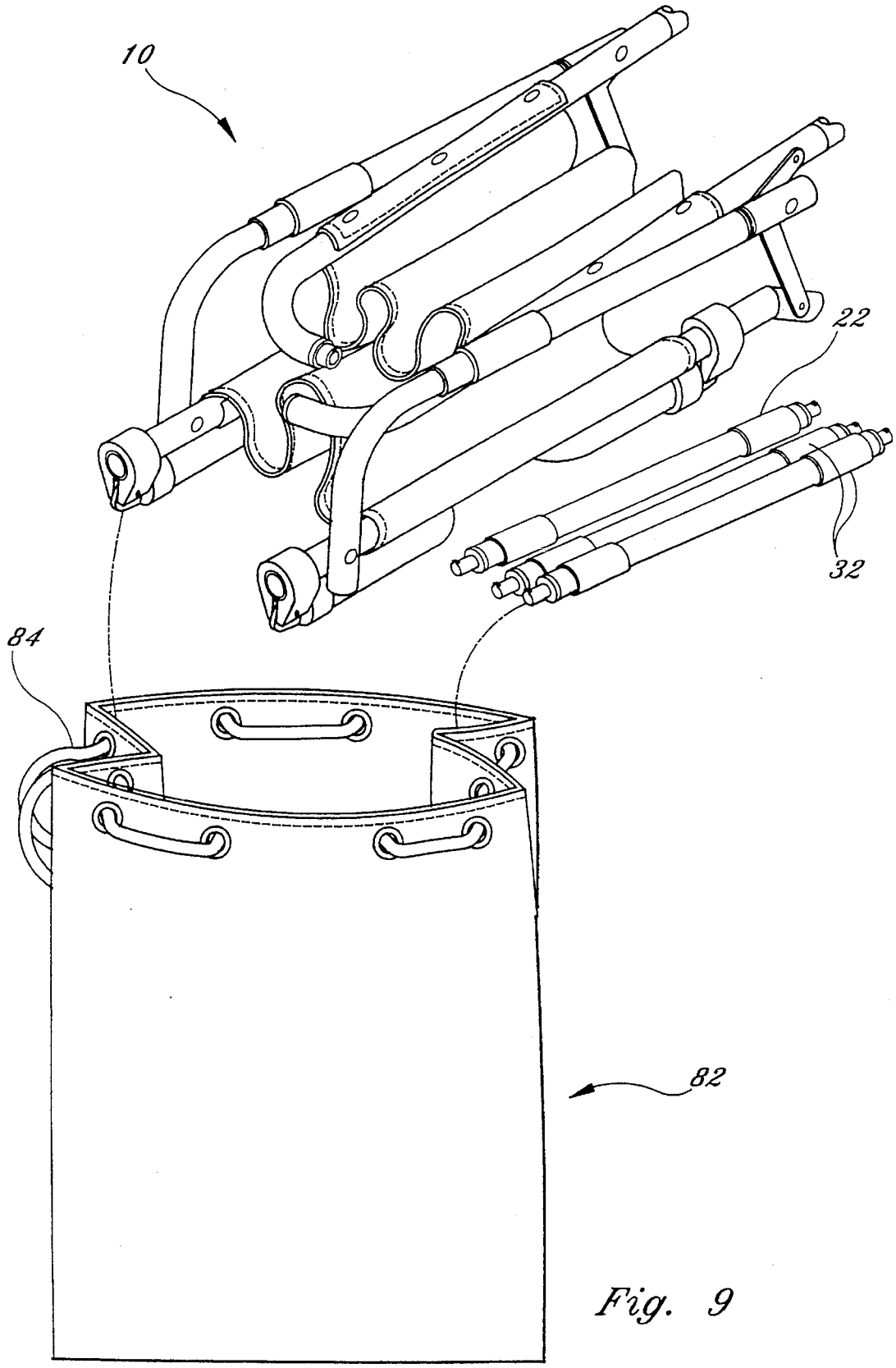
FIG. 9 is a view of the chair in FIG. 1 illustrating the frame collapsed including all side members being L-shaped and all support members together prior to being stored in the tote bag.

To collapse the knock down chair from its fully erected condition shown in FIG. 1, 8, and 9, the back frame 12 is folded forwardly which also causes the arm supporting frames 16 to pivot forwardly. The front and rear leg frames 18 are then folded under the seat frame 14 complete with support members 32 and leg support members 30. The next step is to simply grasp the support tubular members 22, 32 by the hand grips 34 that are positioned at the perspective ends of each tubular member 22, 32, turn to release the couplings 24 and remove.

The chair 10 complete with tubular support members 22, 32 is then secured inside a tote bag 82 with a closure 84 of conventional type. It will be readily appreciated by those skilled in the art, that the chair 10 can be fully erected by reversing these steps.

SUMMARY

Accordingly, those skilled in the art will see that the knock down chair of this invention can be broken down into its knock down state easily and conveniently because of the design of the advanced quick release coupling. Also, the reader will find that the new improved positioning device for the different reclining positions is simple to operate and is economical to manufacture. It will also be appreciated that by virtue of the construction as illustrated and explained the chair is simple in construction, positive in operation, and susceptible of easy folding for transport and stowage purposes.

Although only one form of the invention has been shown and described in detail, it will be apparent to those skilled in the art that the invention is not so limited but that various changes can be made without departing from the spirit of the invention or the scope of the appended claims.

What is claimed is:

1. A knock down chair comprising:

a flexible seatrest and a flexible backrest;

a folding first side assembly;

a folding second side assembly;

three removable elongate transverse members, each transverse member having a long axis and two ends, each end provided with a connector element;

a plurality of connector members attached to the first and second side assemblies;

each connector element adapted for engaging one of said connector members by axial movement therebetween including means for locking securely together with said connector member when engaged by rotation of the transverse member about said long axis;

the transverse members, when securely locked to the two side assemblies, thereby holding the side assemblies in fixed, spaced apart relationship and forming a complete folding chair frame including a back frame supporting the backrest a seat frame supporting the seatrest and two leg frames;

in which the side assemblies must be pulled away from one another after the transverse members have been unlocked by rotation to knock down the chair.

2. The chair according to claim 1, in which one of said transverse members is incorporated into each assembled leg frame and one of said transverse members is incorporated into the assembled back frame.

3. The chair according to claim 1 further comprising a bag arranged for holding said chair when knocked down with each side assembly folded and the transverse members separated therefrom.

4. The chair according to claim 1, in which said transverse members are interchangable.

5. The chair according to claim 1, in which the angle of the back frame relative to the seat frame is adjustable by adjustable securing means.

6. The chair according to claim 5, in which one of said transverse members is incorporated into each assembled leg frame and one of said transverse members is incorporated into the assembled back frame.

* * * * *